United States Patent [19]

Miyashita et al.

[11] 3,998,606

[45] Dec. 21, 1976

[54] METHOD AND APPARATUS FOR MANUFACTURING REDUCING GAS

[75] Inventors: Tsuneo Miyashita; Shoichiro Ohzeki, both of Yokohama; Toshio Nayuki, Kawasaki, all of Japan

[73] Assignee: Nippon Kokan Kabushiki Kaisha, Tokyo, Japan

[22] Filed: Apr. 19, 1974

[21] Appl. No.: 462,589

[30] Foreign Application Priority Data

Apr. 23, 1973 Japan ..... 48-45018

[52] U.S. Cl. ..... 48/71; 48/200; 48/202

[51] Int. Cl.[2] ..... C10J 3/00; C10J 3/16

[58] Field of Search ..... 48/71, 200, 201, 202, 48/203, 210, 197 R, 209; 252/373

[56] References Cited

UNITED STATES PATENTS

| | | | |
|---|---|---|---|
| 2,593,257 | 4/1952 | Bradley et al. | 48/202 X |
| 2,657,124 | 10/1953 | Gaucher | 48/202 X |
| 2,821,465 | 1/1958 | Garbo | 48/197 X |
| 3,615,298 | 10/1971 | Benson | 48/197 |
| 3,832,151 | 8/1974 | Kitaoka et al. | 48/209 |

*Primary Examiner*—R.E. Serwin
*Attorney, Agent, or Firm*—Flynn & Frishauf

[57] ABSTRACT

In a method and apparatus for manufacturing reducing gas by utilizing a slag-tap type furnace wherein a solid carbonaceous substance such as coal and coke is charged into the furnace through the top thereof, steam and oxygen or oxygen-rich air are blown into the furnace through a tuyere at the hearth, the gas produced is discharged from the furnace top and the ash components of the ash substance are discharged from the furnace bottom as a molten slag, a liquefied high calorie substance such as heavy oil, asphalt and plastics is blown into a region of the furnace in which the solid carbonaceous substance is heated to a temperature of from 600° to 1200° C. thus increasing the heat quantity of the gas produced. The efficiency of the furnace can be improved by separating low temperature volatile substances from the gas produced and admitting the separated low temperature volatile substances into the furnace together with steam and oxygen or oxygen-rich air.

24 Claims, 3 Drawing Figures

METHOD AND APPARATUS FOR MANUFACTURING REDUCING GAS

BACKGROUND OF THE INVENTION

This invention relates to a method and apparatus for producing reducing gas, and more particularly to a method and apparatus for producing high calorie reducing gas by using a slag-tap type gas manufacturing furnace and a high calorie substance, for example, heavy oil asphalt and plastic discards.

A number of types of the slag-tap type gas manufacturing furnaces have been described and used commercially in which a solid carbonaceous substance, such as coal and coke, is charged in a shaft furnace and gasified by a mixture of stem and oxygen or oxygen-rich air blasted into the furnace through tuyeres at the hearth of the furnace. The resulting reducing gas is discharged from the furnace top and a molten slag of the ash components is discharged from the furance crucible.

In such a furnace, the solid carbonaceous substance is preheated by the steam and oxygen blown into the furance through the tuyeres, and caused to react with the steam and oxygen at the inlet ends of the tuyeres according to the following equation $$C + \left\{ \begin{matrix} H_2O \\ O_2 \end{matrix} \right\} \longrightarrow H_2 + CO_2 \qquad (1)$$

While rising upwardly, the resulting gas reacts with red heat coal or coke according to the following equation 2, thus forming hydrogen and carbon monoxide:

$$H_2O \;\; CO_2 + CO \rightarrow H_2 + CO \qquad (2.)$$

The ash components consisting essentially of $SiO_2$, $Al_2O_3$, etc. of the coal or coke react with a blast furnace slag or lime stone which is charged into the furnace through the top thereof together with the carbonaceous substance for forming a slag having relatively low melting points. The slag is collected in the crucible of the furnace in a molten state and is discharged to the outside through a tap hole. The molten slag discharged through the tap hole is collected in a water bath to solidify. The resulting gas mixture is used as fuel and the composition thereof generally comprises 50 to 80% CO and about 20% of hydrogen and its heat value is low, of the order of about 3000 Kcal/Nm$^3$. It is reported that gas consisting of 72.4% of CO and 22.6% of $H_2$ has a heat value of 2915 Kcal/NM$^3$. For this reason, in order to use such a gas as fuel gas, it is common to increase its heat quantity by mixing it with high calorie gas such as LPG and butane. The coal utilized as the raw material for operating the slag-tap gas manufacturing furnace generally contains substances which evaporate at low temperatures and the vapor of such substances is discharged from the furnace top together with the gas formed. When cooled, such vapor condenses into an oily substance containing tar, hydrocarbons, free carbons, etc., thus causing various troubles for efficient operation of the furnace. To recover such oily substances as by-products for utilizing them as the raw material for petroleum industry, a large expense is required.

Accordingly, such expensive recovering operations contribute only a little to modern highly developed petroleum industry, and the development of a method and apparatus capable of producing reducing gas of high calorific or heat value without the difficulties described above has long been desired.

SUMMARY OF THE INVENTION

Accordingly, it is an object of this invention to provide an efficient method and apparatus for producing reducing gas having a relatively high heat value.

Another object of this invention is to provide an improved method and apparatus for producing reducing gas by utilizing a slag-tap type gas manufacturing furnace, wherein the efficiency of the furnace can be increased by recovering the low temperature volatile substances from the resulting gas and by using the recovered substance as a raw material for preparing the reducing gas.

According to one aspect of this invention, there is provided a method of manufacturing reducing gas wherein a solid carbonaceous substance is charged into a slag-tap type furnace through the top thereof, steam and oxygen or oxygen-rich air are blown into the furnace through a tuyere at the hearth of the furnace so as to gasify the solid carbonaceous substance, the resulting gas is discharged from the furnace top, and the ash components of the solid carbonaceous substance are discharged from the furnace bottom in the form of a molten slag, characterized in that a liquefied high calorie substance is blown into the furnace thereby increasing the heat quantity of the gas produced. The high calorie substance such as heavy oil, liquefied plastic, fluidized asphalt, etc. is blown into the furnace together with steam in an intermediate region of the furnace maintained at a temperature of from 600° to 1200° C. which is higher than the temperature necessary to convert the ash components into the slag but lower than the temperature at which the gas will not substantially be reduced by the solid carbonaceous substance which is heated to red heat while the gas rises upwardly.

The efficiency of the furnace can be increased by separating low temperature volatile substances from the gas produced and by blowing the separated low temperature volatile substances into the furnace through the tuyere at the furnace hearth together with steam and oxygen or oxygen-rich air.

According to another aspect of this inventon, there is provided apparatus for manufacturing reducing gas comprising a slag-tap type furnace provided with an opening at the top for charging a solid carbonaceous substance into the furnace, a tuyere at the bottom of the furnace for blowing steam and oxygen or oxygen-rich air into the furnace, a discharge opening at the bottom of the furnace for discharging ash components of the solid carbonaceous substance in the form of a molten slag, and a discharge opening near the furnace top for discharging the gas produced, characterized in that a nozzle is provided for the furnace for blowing a heated and liquefied high calorie substance into a region of the furnace in which the solid carbonaceous substance is maintained at a temperature of from 600° to 200° C.

Although the method and apparatus of this invention are similar to said prior art method and apparatus for producing reducing gas in that a solid carbonaceous substance such as coal, coal briquettes, coke or the like is charged through the top of a slag-tap type gas manufacturing furnace, that a mixture of steam and oxygen or oxygen rich air is blown into the furnace through the tuyeres provided at the bottom of the furnace for causing the mixture to react with the solid carbonaceous substance to form reducing gas, and that the ash components contained in the carbonaceous substance are discharged to the outside as a molten slag through a tap-opening at the bottom of the furnace, in accordance with this invention one or more blow nozzles are provided in a region of the furnace in which the temperature of the carbonaceous substance reaches a temperature of from 600° to 1200° C., and one or more of heated and liquefied plastic materials and heavy oils (including asphalt, etc.) are introduced through the blow nozzles. Before admission, plastic or plastic discards are preheated and liquefied and the liquefied plastics are mixed with steam at a proper ratio. Where plastics or plastic discards evolve chlorine gas as in the case of vinyl chloride for example, after heating the plastics to a temperature of about 200° C. for removing hydrochloric acid, the heat treated plastics are charged into a melting tank together with discards of another type of plastics. The solid plastics and the preliminary melted plastics are charged in the melting tank through a dual valve system, in which care should be taken so as to prevent counter flow of the steam and liquefied plastics. Where heavy oil or asphalt are used, they are firstly preheated to a temperature at which they can flow readily and then the preheated heavy oil or asphalt is mixed with steam or a mixture of steam and oxygen or oxygen-rich air (preferably heated air) before they are blown into the furnace. Such preheating can be carried out by using a concentric tube heat exchanger in which the outer tube passes the steam. Alternatively, a mist consisting of a mixture of fine particles of the heavy oil and steam may be blown into the furnace.

According to another feature of this invention, substances evaporating at low temperatures such as tar and aromatic hydrocarbons contained in the gas exhausted from the top of a slag-tap type gas manufacturing furnace which is operated in a manner described above, are recovered in the form of a slurry if free carbons are contained therein. The slurry is then blown into the furnace together with steam and oxygen-rich air through ordinary tuyeres of the furnace. The temperature of the portions of the furnace near the tuyeres is maintained at a temperature in a range, the lower limit being a value which is necessary to convert the ash components of the carbonaceous substance into slag, whereas the upper limit being a value at which the reaction of equation 2 does not occur substantially, that is a range of from 600° to 1200° C. When the temperature is maintained within this range, it is possible to operate the slag-tap type gas manufacturing furnace smoothly so as to suitably adjust the heat value of the resulting gas by the proper selection of the ratio among liquefied plastics, heavy oil, steam and oxygen which are blown into the furnace. By this measure, it is possible to eliminate the trouble caused by the low temperature evaporating substances contained in the gas, thereby ensuring smooth operation of the slag-tap type gas manufacturing furnace.

BRIEF DESCRIPTION OF THE DRAWINGS

The invention can be more fully understood from the following detailed description taken in conjunction with the accompanying drawings in which.

DESCRIPTION OF THE PREFERRED EMBODIMENTS

Figure 1:
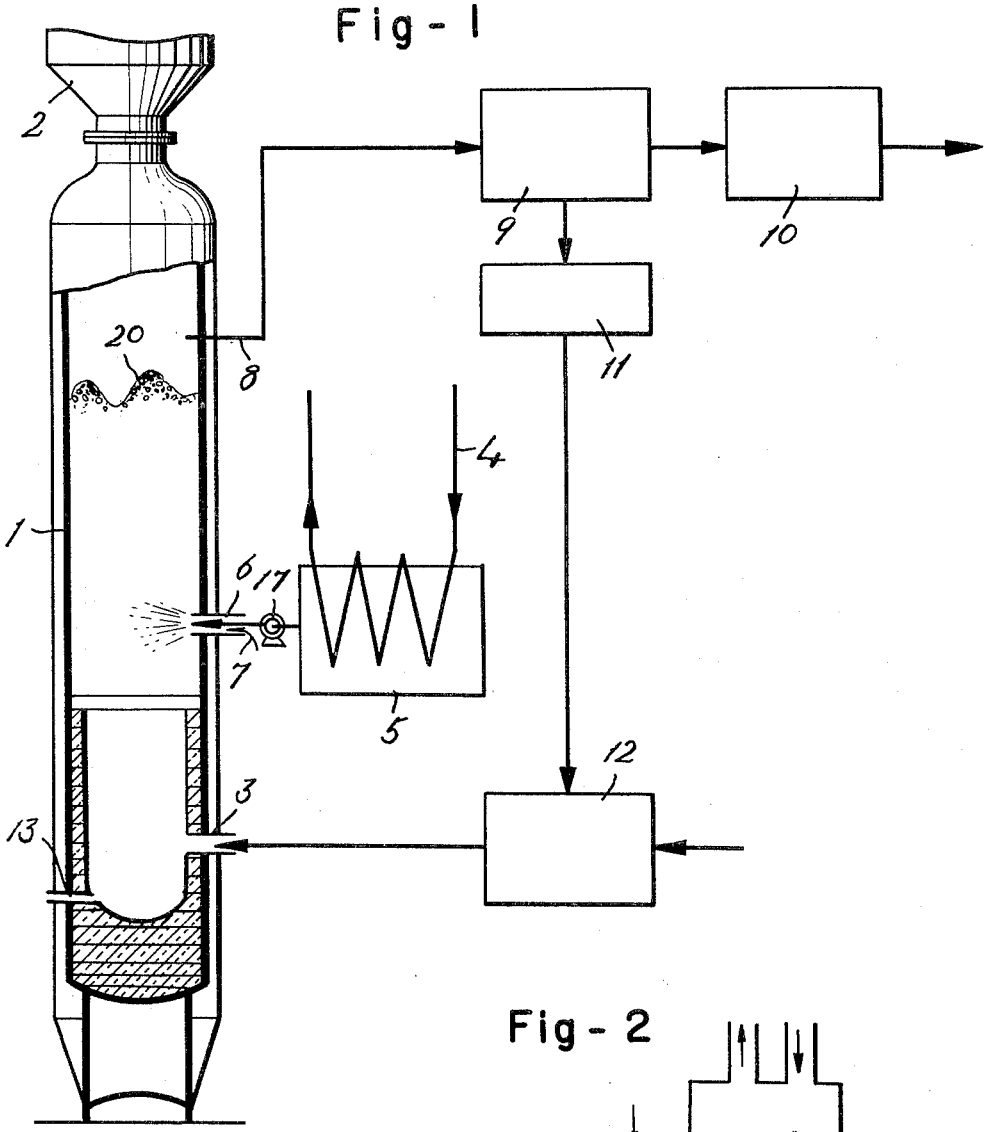
FIG. 1 is a schematic diagram of the apparatus for producing reducing gas constructed in accordance with the teaching of the invention for gasifying heavy oil.

Referring now to FIG. 1 illustrating one embodiment of this invention designed to use heavy oil, the apparatus shown therein comprises a slag-tap type furnace 1 provided with a hopper 2 at the top for charging such carbonaceous substance 20 as coal, coal briquettes and coke into the furnace, and normal tuyere 3 at the bottom for flowing a mixture of steam and oxygen or oxygen-rich air into the furnace for producing reducing gas according to the reactions expressed by equations 1 and 2 described above. The molten slag of the ash components of the carbonaceous substance is discharged to a cooling tank through a tap-opening 13, provided at the bottom of the furnace. The construction thus far described is well known in the art.

In accordance with this invention, in a region of the furnace in which the charge is maintained at a temperature of from 600° to 1200° C., there are provided one or more nozzles 6 through which heavy oil or viscous oil melted in a melting furnace 5 is injected by means of a pump 17 together with steam and oxygen or oxygen-rich air as shown by an arrow 7. Instead of providing an independent melting furnace, a pipe 4 for conveying heavy oil may be surrounded by a pipe conveying the steam. However, in the case of using asphalt or viscous oil, as it is generally difficult to smoothly inject it, it is advantageous to use a mixture of atomized heavy oil and steam. The gas formed in the furnace is discharged to the outside through a discharge opening 8 near the top. Since the gas generally contains dust, low temperature volatile components of coal or tar and water, the exhausted gas is passed through a dust remover 9 such as an electric dust collector, a washing tower, or a combination thereof and thence through a desulfurizer 10 to remove such components harmful to public health as the dusts of tar and carbon, $H_2S$, $CO_2$, etc. The cleaned gas is used as fuel, reducing gas, and for other various applications.

Figure 2:
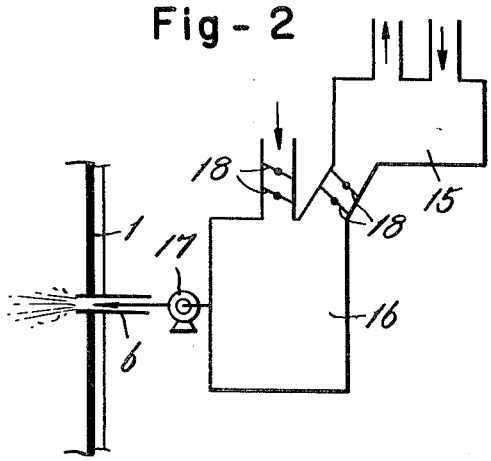
FIG. 2 is diagrammatic of a melting furnace and a pre-treating furnace where plastics or plastic discards are blown into the furnace.
Figure 3:
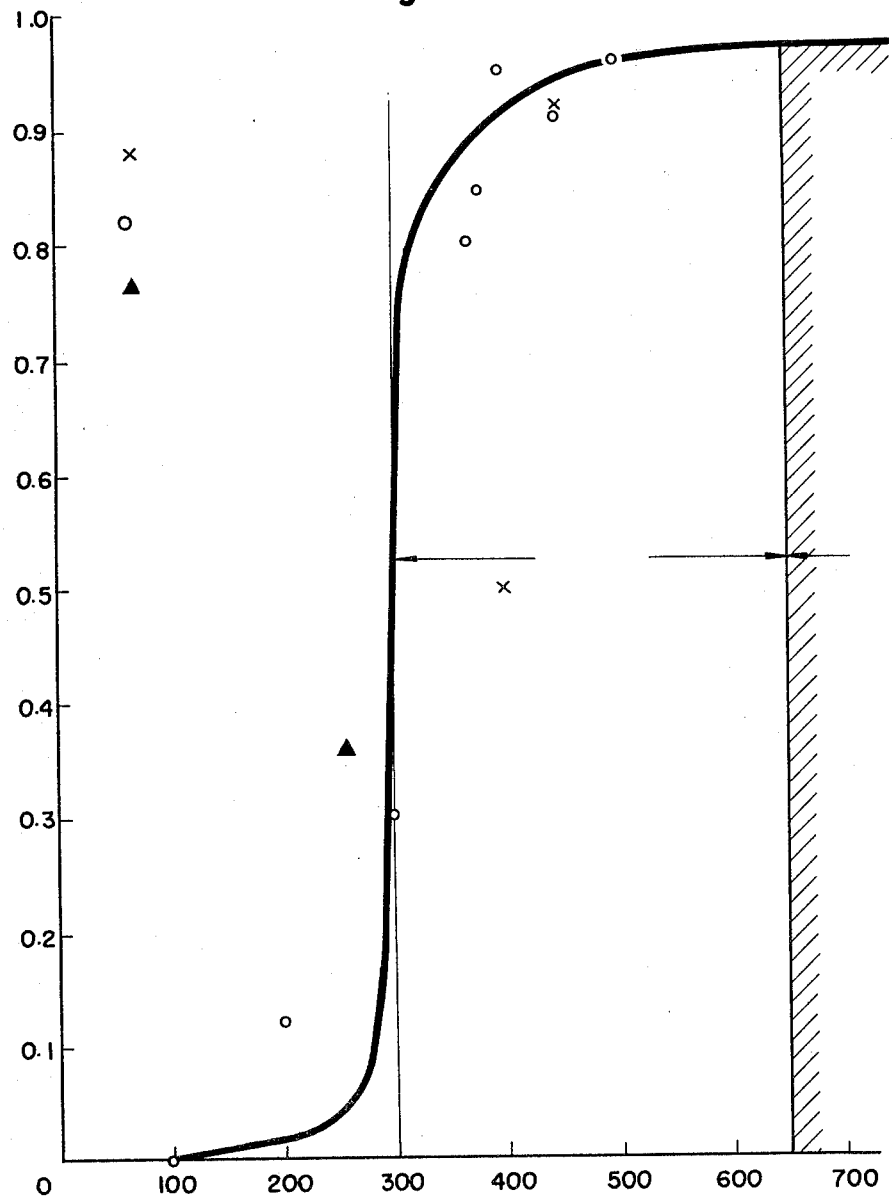
FIG. 3 is a graph showing the relationship between the temperature and the melting condition of plastics.

In the case of using plastics or plastic discards the melting furnace 5 is modified as shown in FIG. 2. More particularly, a melting tank 16 provided with double sealing means 18 is installed before the nozzle 6. Plastics liable to evolve chlorine, such as vinyl chloride, are firstly charged in a pretreating furnace 15 for removing HCl and chlorine content. The plastics removed of chlorine contents are then transferred into the melting furnace 16 through one of the sealing means 18, whereas another plastics not containing chlorine such as polyethylene, polystyrene, polypropylene, etc. are charged directly into the melting furnace 16 through the other sealing means. The sealing means 18 are constructed to prevent reverse flow of steam and the molten plastics. The plastics are heated in the melting furnace 16 to a temperature necessary to liquefy the plastics. If this temperature is lower than 300° C., certain portion of the solid will not be liquefied, whereas with temperatures higher than 650° C. the plastics tend to decompose to form soot as shown in FIG. 3. FIG. 3 is a graph showing the relationship between the percentage of liquefaction and the temperature of various plastics in which a symbol $x$ shows the liquefying temperature of polyethylene, *o* that of polystyrene and Δ that of heavy oil A. The region between about 300° C. and 650° C. is a region of liquefaction, whereas the region to the right of a vertical line at about 650° C. shows a region of gasification.

Furthermore, in accordance with this invention the dust removed by the dust separator 9 is sent to a water separator 11 to remove the water contained therein, and the dust from which water has been removed and consisting of tar, aromatic hydrocarbons or carbonaceous substances is then mixed with fuel oil, if desired, to form a slurry which is then blown into the furnace 1 through the ordinary tuyere or tuyeres 3 by means of a slurry pump 12. If the quantity of the slurry is excessive, the interior of the furnace is cooled to such an extent that the molten slag of the ash components of the carbonaceous raw material solidifies again or causes the molten slag to blow back to the tuyere 3 to clog its discharge port. The reaction occurring near the normal tuyere 3 proceeds according to the following equation 3:

$$\left\{\begin{matrix} CmHn \\ C \end{matrix}\right\} + \left\{\begin{matrix} H_2O \\ O_2 \end{matrix}\right\} \longrightarrow CO_2 + H_2O + CO + H_2 \qquad (3)$$

As shown by this equation, the tar, aromatic hydrocarbon (shown by CmHn) and free carbon (C) react with steam and $O_2$ blown into the furnace to form $CO_2$, $H_2O$, CO and $H_2$. The $CO_2$ and $H_2O$ thus formed react with the coal or coke present at a high temperature in the furnace according to equation 2, thus forming gas consisting essentially of CO and $H_2$.

Considering the heat balance in a region about the normal tuyere 3, the following equation 4 holds:

$$YO_2.qC = Yj.qj + Yg.Vg + l.ql + qe \qquad (4).$$

in which respective symbols have the following meaning:

- $YO_2$ : the quantity of $O_2$ supplied in the form of oxygen or oxygen-rich air
- $qC$ : heat quantity generated by the reaction of $YO_2$ and carbon
- $Yj.qj$ : heat quantity related to water gas reaction
- $Yg.Vg$ : sensible heat generated near the tuyere and conveyed to the upper part of the furnace
- $l$ : quantity of the slag formed by coal or coke
- $q.l$ : sensible heat of the slag
- $qe$ : heat loss.

In order to operate the furnace satisfactorily, it is necessary to satisfy the following equation 5:

$$ql \geqq T_s.C_s$$

where $T_s$ represents the temperature at which the slag from coal or coke can exist in a molten state and $C_s$ the specific heat of the slag per unit volume. It should be understood that the values of $T_s$ and $C_s$ vary depending upon the composition of the slag. Thus, it will be clear that smooth operation of the furnace can be assured when the tar recovered under conditions as specified by equations 3 to 5 is blown into the furnace 1 through the normal tuyere.

To have better understanding of this invention, the following examples are illustrated but not for limitation.

EXAMPLE 1

Blowing of Heavy Oil

In the manufacture of reducing gas by charging 599 Kg of coke into the furnace 1 described above and by blowing 217 Kg of steam and 50 $Nm^3$ of oxygen into the furnace through the normal tuyere 3, 300 Kg of heavy oil was ejected through nozzle 6.

1300 $Nm^3$ of gas was produced having the following composition:

| | |
|---|---|
| CO | 55.7% |
| $H_2O$ | 22.3% |
| $CH_4$ | 13.0% |
| $C_2H_6$ | 1.0% |
| $C_2H_4$ | 4.3% |
| $C_3H_6$ | 0.2% |
| $N_2$ | 1.2% |

The total heat quantity of this gas was 4430 Kcal/$Nm^3$.

EXAMPLE 2

Blowing of By-products Such as Tar

When the furnace was operated under the same conditions as in Example 1, 147 Kg of a by-product containing free carbon and tar was separated by dust remover 9 and this by-product was blown into the furnace 1 through the normal tuyere 3 together with 85 $Nm^3$ of $O_2$ and 73 Kg of steam to obtain 1720 $Nm^3$ of gas having the following composition.

| | |
|---|---|
| $CO_2$ | 1.6% |
| CO | 57.2% |
| $H_2$ | 26.2% |
| $CH_4$ | 9.8% |
| $C_2H_6$ | 0.7% |
| $C_2H_4$ | 3.2% |
| $C_3H_6$ | 0.1% |
| $N_2$ | 0.9% |

The gas had a total calorie value of 4100 Kcal/$Nm^3$.

EXAMPLE 3

Blowing of Plastics

A melting furnace 16 and a pretreating furnace 15 were connected to the nozzle 6 as shown in FIG. 2, and the furnace 1 was operated under the same conditions as in Example 1 except that heavy oil was substituted by 300 Kg of molten plastics.

1300 $Nm^3$ of gas formed having the following composition

| | |
|---|---|
| CO | 56.0% |
| $H_2$ | 21.7% |
| $CH_4$ | 13.9% |
| $C_2H_6$ | 1.0% |
| $C_2H_4$ | 7.4% |

The resulting gas had a total calorie value of 4600 Kcal/$Nm^3$.

EXAMPLE 4

Blowing of Vinyl Chloride

When operating the furnace under the same conditions as in Example 3, 90 Kg of polyvinyl chloride was separated from 300 Kg of collected plastic discards and this quantity of polyvinyl chloride was charged into the pretreating furnace 15 and heated to 205° C. to remove HCl. Then the polyvinyl chloride was transferred into the melting furnace 16 while the remaining plastic discards not containing polyvinyl chloride were charged directly into the melting furnace 16. 1220 $Nm^3$ of gas was formed having the following composition.

| | |
|---|---|
| CO | 59.7% |
| $H_2$ | 22.0% |
| $CH_4$ | 11.7% |
| $C_2H_4$ | 5.9% |
| $C_2H_6$ | 0.7% |
| $N_2$ | 1.3% |

And the resulting gas had a total calorie value of 4590 Kcal/$Nm^3$.

EXAMPLE 5

Charging of a Mixture of Coal and Coke

In this example a mixture of 515 Kg of coal and 150 Kg of coke (the ratio of incorporation of coke is equal to 24%) was charged into the furnace 1 which was operated with the same quantities of $O_2$, steam and heavy oil A blown into the furnace as in Example 1. 1460 $Nm^3$ of gas produced having the following composition.

| | |
|---|---|
| $CO_2$ | 3.8% |
| CO | 49.6% |
| $H_2$ | 25.4% |
| $CH_4$ | 15.0% |
| $C_2H_6$ | 1.1% |
| $C_2H_4$ | 3.8% |
| $N_2$ | 1.1% |

The total calorie value of the gas produced was 4400 Kcal/$Nm^3$.

The reducing gas of increased calorie value prepared by the method of this invention is suitable for use in various process steps of manufacturing iron and other applications. In an ordinary iron manufacturing plant, blast furnaces and coke furnaces comprise the source of gas. The gas generated by a blast furnace has a calorie value of about 850 Kcal/$Nm^3$ whereas the gas produced by a coke furnace has a higher calorie value of about 4500 Kcal/$Nm^3$. The former gas can be used in applications in which low calorie gas can be used, such as boilers in electric power generating stations, whereas the latter gas can be used in applications requiring high calorie gas such as heating furnaces or the like.

Since the gas generated in a coke furnace is a by-product, its quantity is limited. In iron manufacturing plants since the quantity of gas produced by coke furnaces is not sufficiently large, butane or naphtha is used at present.

The quantity of coke furnace gas is not sufficiently large to be used as the raw material for manufacturing reducing gas, whereas blast furnace gas contains $CO_2$ and $N_2$ at high percentages so that its calorie value is low.

The reducing gas prepared by the method of this invention has a high calorie value so that it can be used in iron manufacturing plants as high calorie gas in lieu of coke furnace gas without adding butane or naphtha. Accordingly, it can be used not only as the fuel gas in many types of furnaces such as heating furnaces, coke furnaces, sintering furnaces or the like but also as the raw material for preparing reducing gas adapted to be blown into the blast furnaces.

In addition, the reducing gas can also be used as the raw material gas for use in synthetic chemistry and town gas if it is processed in a CO converter or subjected to a process of methanation.

We claim:

1. In a method of manufacturing reducing gas wherein a solid carbonaceous substance is charged into a slag-tap type furnace through the top thereof, steam and oxygen or oxygen-rich air are blown into the furnace through a tuyere at the hearth of the furnace so as to gasify said carbonaceous substance, resulting gas is discharged from the furnace top and the ash components are discharged from the furnace bottom in the form of a molten slag, the improvement which comprises discharging all of said resulting gas from the furnace top and blowing a liquefied high calorie substance into said furnace at a region maintained at a temperature higher than the temperature necessary to crack said high calorie substance into a high calorific gas but lower than the temperature at which said gas will not react with the red-heated solid carbonaceous substance while passing upwardly therein, thus increasing the heat quantity of the gas produced.

2. The method according to claim 1 wherein said solid carbonaceous substance comprises coal, coal briquettes or coke.

3. The method according to claim 1 wherein said region is maintained at a temperature of from 600° to 1200° C.

4. The method according to claim 1 wherein a preheated and fluidized heavy oil is blown into said region of said furnace together with steam and oxygen or oxygen-rich air.

5. The method according to claim 1 wherein plastic discards preheated to a temperature of from 300° to 650° C and liquefied are blown into said furnace together with steam.

6. The method according to claim 5 wherein a chlorine containing plastic is preheated to a temperature of about 200° C to remove chlorine and then liquefied.

7. In a method of manufacturing reducing gas wherein a solid carbonaceous substance is charged into a slag-tap type furnace through the top thereof, steam and oxygen or oxygen-rich air are blown into the furnace through a tuyere at the hearth of the furnace so as to gasify said carbonaceous substance, and resulting gas is discharged from the furnace top and the ash components of the solid carbonaceous substance are discharged from the furnace crucible in the form of a molten slag, the improvement which comprises the steps of discharging all of said resulting gas from the furnace top, blowing a heated and liquefied high calorie substance into said furnace at a region maintained at a temperature higher than the temperature necessary to crack said high calorie substance into a high calorific gas but lower than the temperature at which said gas will not react with the red-heated solid carbonaceous substance while passing upwardly therein, removing water from low temperature volatile substances collected from the gas exhausted from the furnace top, and then blowing the dehydrated low temperature volatile substances into the furnace through said tuyere together with steam and oxygen or oxygen-rich air.

8. The method according to claim 7 wherein said high caloric substance comprises a member selected from the group consisting of heavy oil, plastics and asphalt.

9. The method according to claim 7 wherein the quantity of said low temperature volatile substances is controlled so as to maintain the slag at the furnace crucible in a molten state and to establish desired heat balance of said tuyere at the furnace hearth.

10. Apparatus for manufacturing reducing gas comprising:

a slag-tap type furnace provided with an opening at the top for charging a solid carbonaceous substance into the furnace;

a tuyere at the hearth of the furnace for blowing steam and oxygen or oxygen-rich air into said furnace;

a first discharge opening at the crucible of said furnace for discharging the ash components of said solid carbonaceous substance in the form of a molten slag;

a second discharge opening near the furnace top for discharging the gas produced;

a source of a heated and liquefied high calorie substance;

a source of gas; and a nozzle coupled to said gas source and to said high calorie substance source for atomizing said heated and liquefied high calorie substance and blowing said atomized high calorie substance into a region of said furnace in which said solid carbonaceous substance is maintained at a temperature of from 600° to 1200° C.

11. The apparatus according to claim 10 wherein said region is located at an intermediate point between the top and bottom of said furnace.

12. The apparatus according to claim 10 wherein said solid carbonaceous substance comprises coal, coal briquettes and coke.

13. The apparatus according to claim 10 wherein said high calorie substance is selected from the group consisting of heavy oil, asphalt and plastics.

14. The apparatus according to claim 10 wherein said source of a heated and liquefied high calorie substance comprises a melting tank coupled to said nozzle for melting said high calorie substance.

15. The apparatus according to claim 14 wherein said source of a heated and liquefied high calorie substance further comprises a pretreating furnace connected to said melting tank through valve means.

16. The apparatus according to claim 10 which further comprises a dust remover connected to said discharge opening for removing low temperature volatile substances from the gas discharged from said discharge opening; a dehydrator for removing water from the low temperature volatile substances removed by said dust remover; and means for admitting the dehydrated low temperature volatile substances into said furnace through said tuyere at the hearth of said furnace.

17. The apparatus according to claim 16 wherein said removed low temperature volatile substances comprise tar, aromatic hydrocarbons and free carbon.

18. The apparatus according to claim 16 wherein said dehydrated low temperature volatile substances admitted into the furnace is incorporated with fuel oil.

19. The apparatus according to claim 14 wherein said source of a heated and liquefied high calorie substance further comprises a pump coupling said melting tank to said nozzle for supplying said heated and liquefied high calorie substance at a high pressure to said nozzle.

20. The apparatus according to claim 15 wherein said pretreating furnace has a charging inlet for receiving materials to be heated; and said melting tank has a first charging inlet coupled to an outlet of said pretreating furnace for receiving material from said pretreating furnace, and a second charging inlet for directly receiving material to be heated and liquefied.

21. The apparatus according to claim 20 wherein said valve means is provided in both of said inlets of said melting tank.

22. The apparatus according to claim 20 wherein said high calorie substance comprises a plastic material, said pretreating furnace receiving plastic material liable to evolve chlorine and including means for pretreating said plastic material for removing HCl and chlorine from said material, and means for feeding said pretreated plastic material to said first charging inlet of said melting tank; and wherein said second charging inlet of said melting tank is charged directly with plastics not containing chlorine.

23. The apparatus according to claim 10 wherein said heated and liquefied high calorie substance comprises a plastic material, and wherein said melting tank includes means for heating said plastic material to a temperature between 300° C and 650° C so as to liquefy said plastic material.

24. The apparatus according to claim 14 wherein said sources of gas includes a source of steam and oxygen or oxygen-rich air.

* * * * *

UNITED STATES PATENT AND TRADEMARK OFFICE

CERTIFICATE OF CORRECTION

PATENT NO. : 3,998,606

DATED : December 21, 1976

INVENTOR(S) : TSUNEO MIYASHITA et al

It is certified that error appears in the above-identified patent and that said Letters Patent are hereby corrected as shown below:

Column 1, line 11: after "heavy oil", insert a comma (,).

Column 1, line 36, equation (2): replace "$H_2O$ $CO_2$ + CO" with --- $H_2O + CO_2 + C$ ---.

Column 6, line 6: replace "50 $Nm^3$" with --- 250 $Nm^3$ ---.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*